US006336680B1

(12) United States Patent
Lee

(10) Patent No.: US 6,336,680 B1
(45) Date of Patent: Jan. 8, 2002

(54) HEIGHT-ADJUSTMENT MECHANISM FOR ARMREST

(76) Inventor: Ching-Yang Lee, No. 12, Fu Kuei Hsin Tsuen,Alley 6, Heng Shan Tsuen, Heng Shan Hsiang Cuu Hsien (TW)

( * ) Notice: Subject to any disclaimer, the term of this patent is extended or adjusted under 35 U.S.C. 154(b) by 0 days.

(21) Appl. No.: 09/897,982

(22) Filed: Jul. 5, 2001

(51) Int. Cl.[7] ..... A47C 7/54
(52) U.S. Cl. ..... 297/411.36
(58) Field of Search ..... 297/411.36, 353

(56) References Cited

U.S. PATENT DOCUMENTS 5,318,347 A * 6/1994 Tseng ..... 297/411.36
5,439,267 A * 8/1995 Peterson et al. ..... 297/411.36
5,586,811 A * 12/1996 Tornero ..... 297/411.36
5,620,233 A * 4/1997 Corwin ..... 297/411.36
6,209,840 B1 * 4/2001 Chen ..... 297/411.36

* cited by examiner

*Primary Examiner*—Peter R. Brown
(74) *Attorney, Agent, or Firm*—Dougherty & Troxell

(57) ABSTRACT

A height-adjusting mechanism for armrest includes a slider movably mounted in a slide way of a sleeve connected at a lower end to a seat of an armchair. A retaining block horizontally extends through a transverse hole on the slider and into one of many vertically spaced locating holes on the slide way to hold the slider at a certain height relative to the sleeve. A long plate having a top handle is attached to one side of the slider and could be pulled upward and elastically return to an original position when being released. When the long plate is pulled upward, it drives the retaining block to disengage from the locating hole and allows the slider to freely move up and down. And, when the long plate is released, the retaining block is driven to engage into another locating hole to hold the slider to a new height.

4 Claims, 6 Drawing Sheets

HEIGHT-ADJUSTMENT MECHANISM FOR ARMREST

BACKGROUND OF THE INVENTION

The present invention relates to a height-adjusting mechanism for armrest that enables easily adjustment of an armrest to a desired height relative to a seat of an armchair simply by pulling upward a handle and moving the armrest to a desired position and then releasing the handle.

There are different designs for armrests of armchairs. There are also different mechanisms for adjusting armrests to different heights and/or different open angles, so that users sit on the armchairs more comfortably and the armchairs are more valuable. The mechanisms for adjusting armrests are kept improved mostly in their spatial configurations, number of parts, and/or operating manners, so as to create armchairs having different structures, improved functions or reduced manufacturing cost to increase their competition ability in the markets.

SUMMARY OF THE INVENTION

A primary object of the present invention is to provide a height-adjusting mechanism for armrest. The mechanism mainly includes a slider movably mounted in a slide way of a sleeve connected at a lower end to a seat of an armchair. An armrest is connected to a top of the slider. A retaining block horizontally extends through a transverse hole on the slider and into one of many vertically spaced locating holes on the slide way to hold the slider to a certain height relative to the sleeve. A long plate having a top handle is attached to one side of the slider and could be pulled upward and elastically return to an original position when being released. When the long plate is a pulled upward, it drives the retaining block to disengage from the locating hole and allows the slider to freely move up and down. And, when the long plate is released, the retaining block is driven to engage into another locating hole to hold the slider to a new height.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
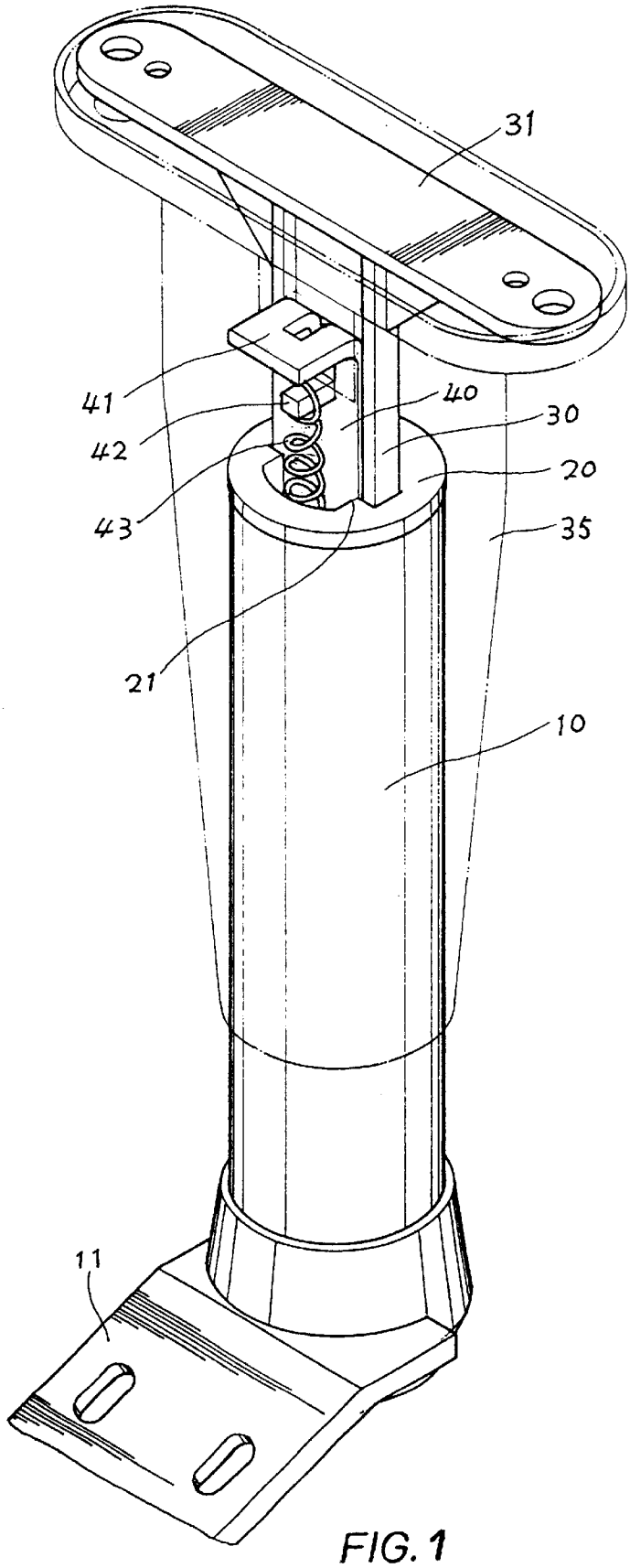
FIG. 1 is an assembled perspective view of a height-adjusting mechanism for armrest according to a first embodiment of the present invention.
Figure 2:
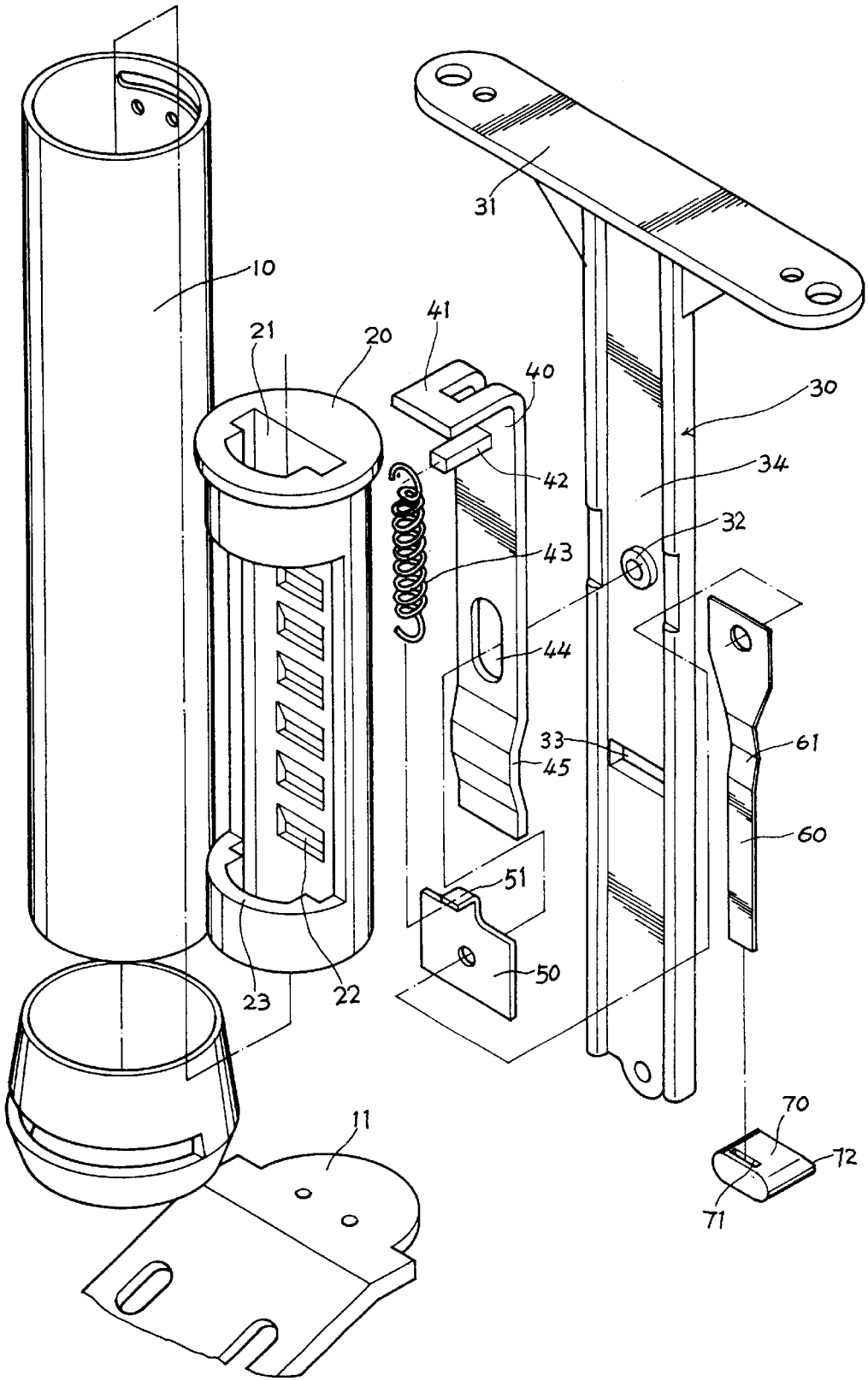
FIG. 2 is an exploded perspective view of the height-adjusting mechanism for armrest of FIG. 1.

Please refer to FIGS. 1 through 4 in which a height-adjusting mechanism for armrest according to a first embodiment of the present invention is shown.

The height-adjusting mechanism for armrest includes a sleeve 10, a lower end of which is screwed to a bracket 11 that is then screwed to a seat of an armchair (not shown) to form an arm support. A tubular member 20 is mounted in the sleeve 10 with an upper end seated on a top of the sleeve 10. The tubular member 20 is provided with an internal slide way 21, an inner side of which is provided with a vertical row of equally spaced locating holes 22. A wall of the tubular member 20 opposite to the slide way 21 is cut away to form a vertically extended an access window 23, via which related components or parts are conveniently mounted in the tubular member 20.

A slider 30 is vertically movably received in the slide way 21. The slider 30 includes an arm bracket 31 additionally connected to or integrally formed at a top thereof for an armrest (not shown) to connect to the arm bracket 31, and a vertical trough 34 formed at an outer side of the slider 30. A fixing hole 32 and a transverse through hole 33 are separately provided at predetermined positions in the trough 34. An exterior cover 35 may be connected to the slider 30 to create an integral appearance of the height-adjusting mechanism.

A long plate 40 is located at the outer side of the slider 30 in the trough 34 and has an outward bent upper end to provide a handle 41 that is accessible from outside of the outer cover 35, a horizontal lug 42 provided below the handle 41 for a spring 43 to connect at an upper end thereto, a vertical long slot 44 formed below the lug 42, and an outward protruded portion 45 formed below the long slot 44.

A fixing plate 50 and an elongate guiding plate 60 are sequentially attached to an outer side of the long plate 40, so that the fixing plate 50 and the guiding plate 60 and the long plate 40 are together fixed onto the slider 30 with the long slot 44 corresponding to the fixing hole 32.

The long plate 40 is vertically movable in the trough 34 within a range defined by upper and lower ends of the long slot 44. The fixing plate 50 has an outward bent lug 51 at its top to connect to a lower end of the spring 43, such that the long plate 40 automatically returns to a lower position under an elastic force of the spring 43 when the long plate 40 is upward pulled and released again.

The guiding plate 60 is formed at a predetermined position with an inward protruded portion 61 to face toward the outward protruded portion 45 of the long plate 40. The guiding plate 60 is connected to a transverse retaining block 70 by engaging a lower end of the guiding plate 60 with a slot 71 at an outer end of the retaining block 70.

The retaining block 70 is adapted to extend an inner end 72 through the transverse slot 33 on the slider 30 and extend into one of the locating holes 22 on the slide way 21. The inner end 72 of the retaining block 70 has a configuration corresponding to that of the locating hole 22 and preferably includes a right-angled lower end surface and a beveled upper end surface. This configuration allows the retaining block 70 to move only upward to pass over a locating hole 22 but not downward to disengage from the locating hole 22. That is, the retaining block 70 works like a ratchet to allow a one-way adjustment of its position.

Figure 3:
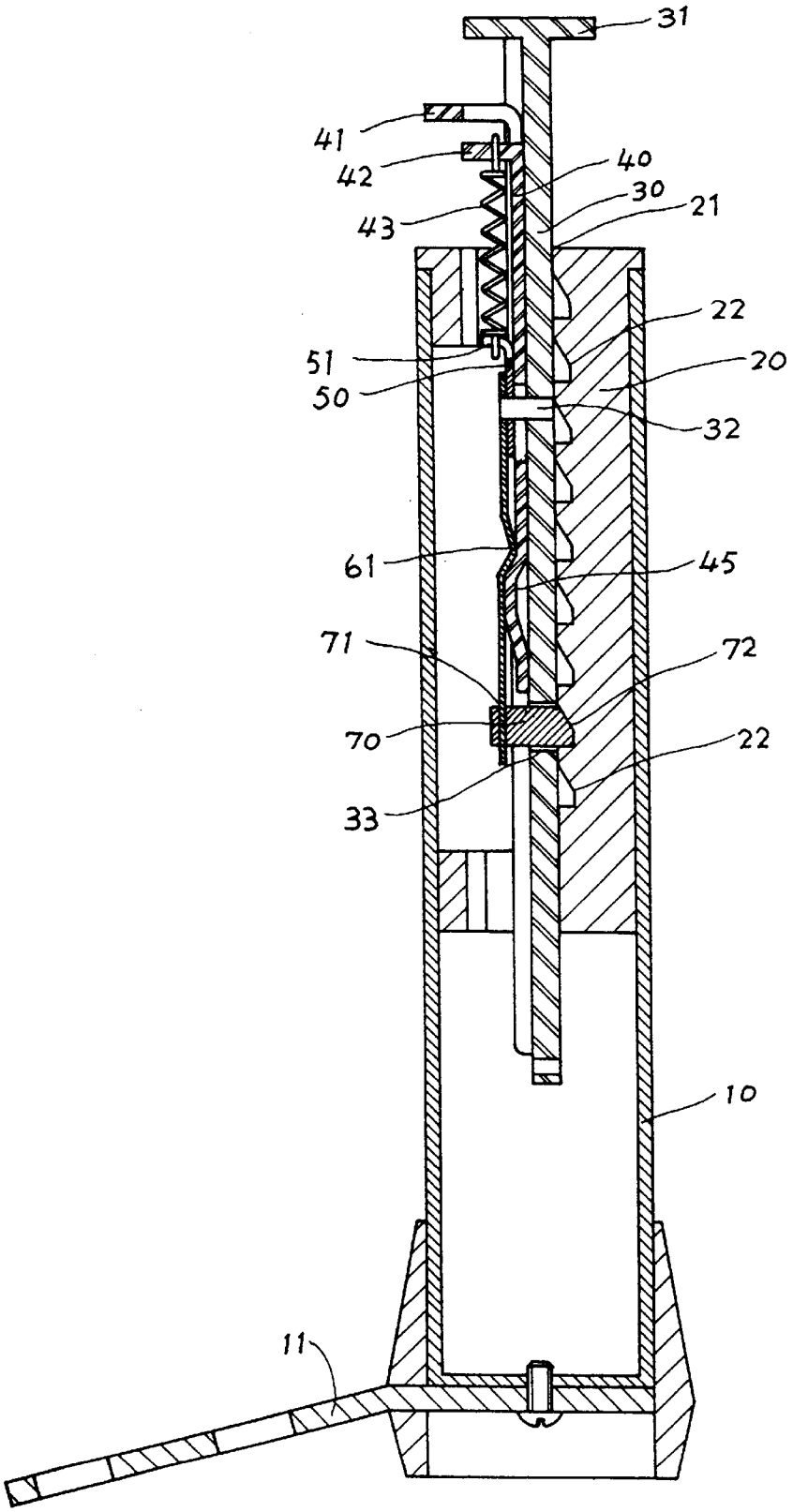
FIG. 3 is a sectioned side view of the height-adjusting mechanism for armrest of FIG. 2.

When the handle 41 is not upward pulled, as shown in FIG. 3, the outward protruded portion 45 of the long plate 40 is located below the inward protruded portion 61 of the guiding plate 60, the guiding plate 60 has a lower end in a vertically downward extended position, and the retaining block 70 is in engagement with one of the locating holes 22. Since the retaining block 70 is extended through the transverse slot 33 on the slider 30, the slider 30 is held by the retaining block 70 at a fixed height.

There are several different ways to adjust the height of an armrest mounted to the arm bracket 31 relative to a seat of the armchair:

(1) To adjust the armrest to a higher position, a user may directly pulls the armrest upward to move the slider 30 upward. With an inherent elasticity of the long plate 60 and the one-way adjustment function of the retaining block 70, the retaining block 70 is brought by the upward pulled long plate 40 to upward pass over each upper locating hole 22 until the armrest reaches a desired height. At this point, the retaining block 70 is located in a new locating hole 22 to complete the height adjustment of the armrest.

Figure 4:
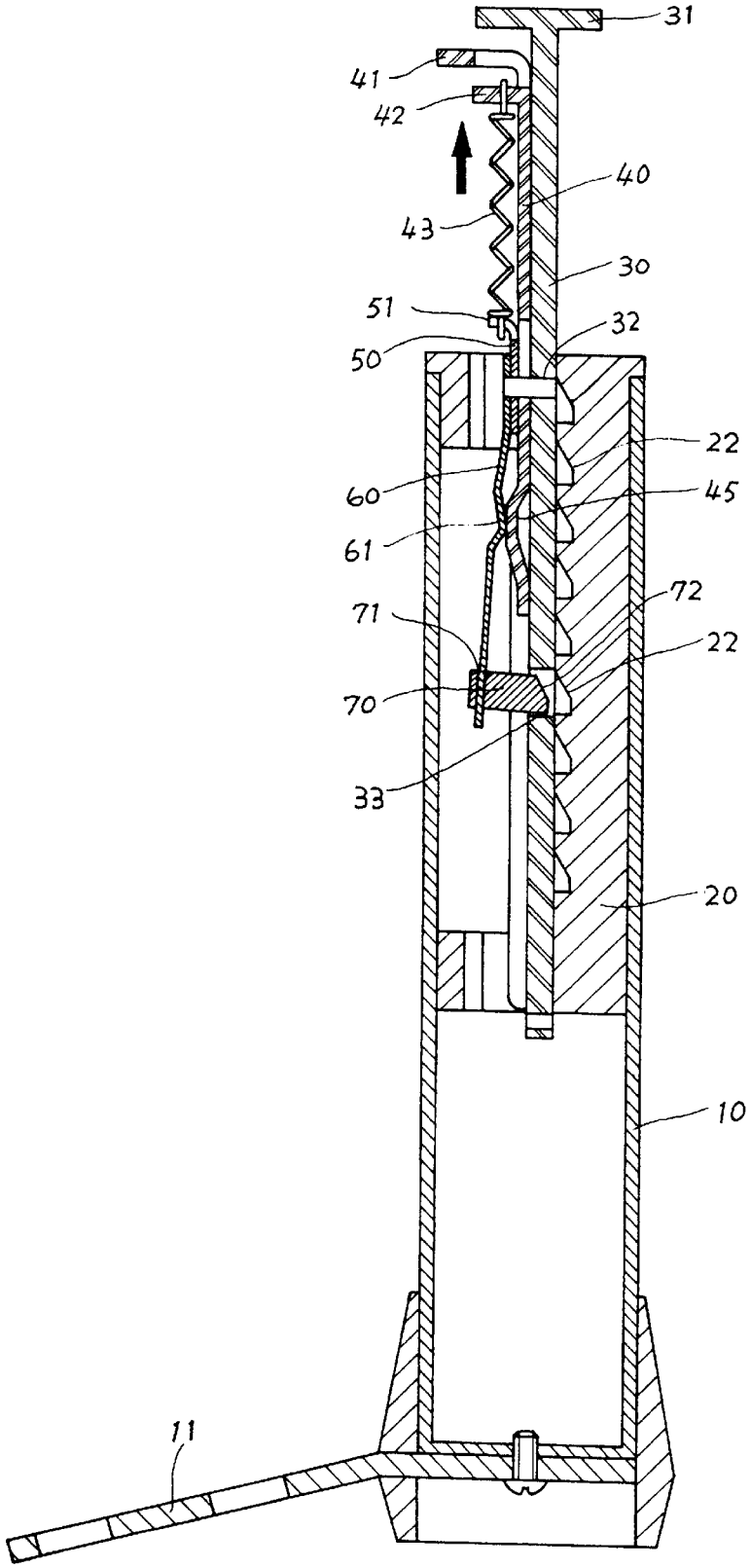
FIG. 4 shows the height-adjusting mechanism for armrest of FIG. 3 is adjusted to a higher position.

(2) To adjust the armrest to a lower position, a user may first pull the handle 41 upward, as shown in FIG. 4, so that the long plate 40 moves upward and the outward protruded portion 45 is brought to push against the inward protruded portion 61 of the guiding plate 60, causing the lower end of the guiding plate 60 to shift outward to leave the original downward vertical position and the retaining block 70 to disengage from the locating hole 22. At this point, the slider 30 in the slide way 21 is allowed to freely move downward until the armrest reaches a desired height. The handle 41 is then released, and the retaining block 70 is automatically pulled by the elasticity of the guiding plate 60 to engage into a new locating hole 22 at a lower position to complete the adjustment of the armrest.

(3) To adjust the armrest to either a higher or a lower position, a user may pull the handle 41 upward, as shown in FIG. 4, so that the slider 30 is freely slidable up and down in the slide way 21. At this point, the user may move the armrest upward or downward to a desired position and then releases the handle 41.

(4) Alternatively, a user may first pull the handle 41 upward to free the slider 30, and then pushes the armrest to a lowest position before releases the handle 41. Thereafter, the armrest may be pulled upward to a desired height in the manner as described in the above paragraph (1).

Figure 5:
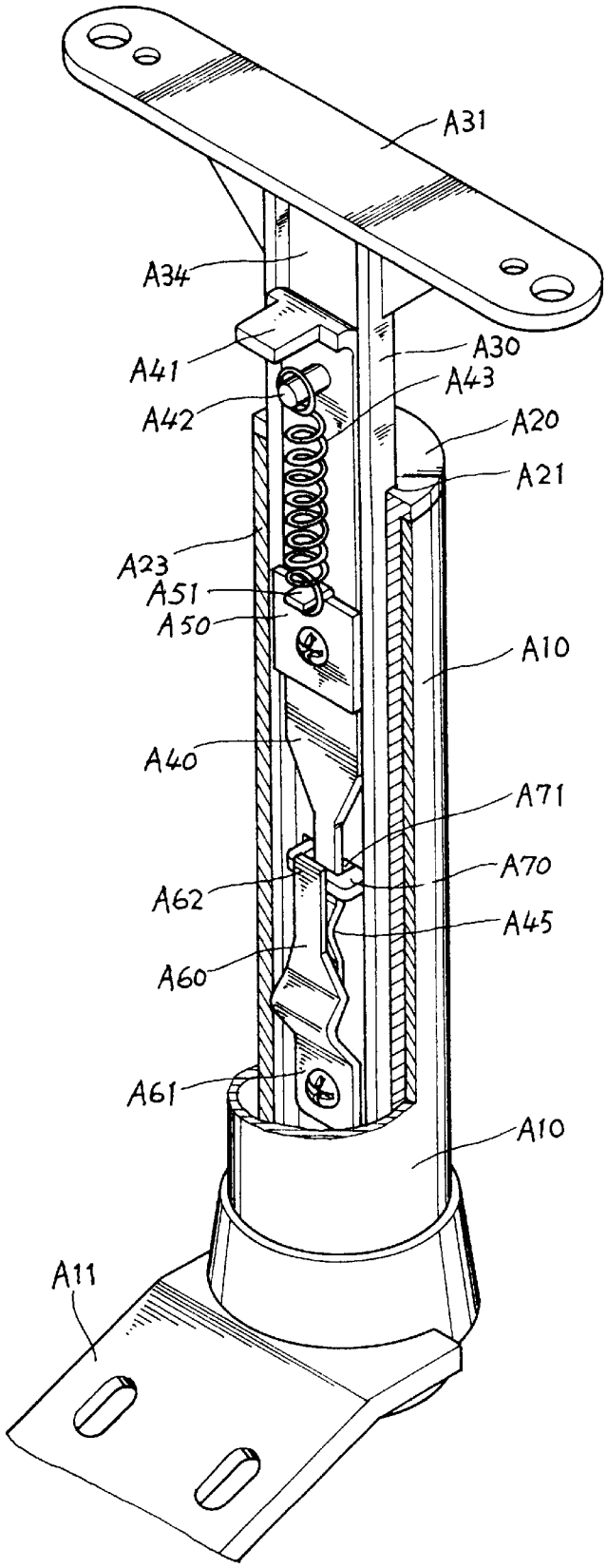
FIG. 5 is an assembled perspective view of a height-adjusting mechanism for armrest according to a second embodiment of the present invention.
Figure 6:
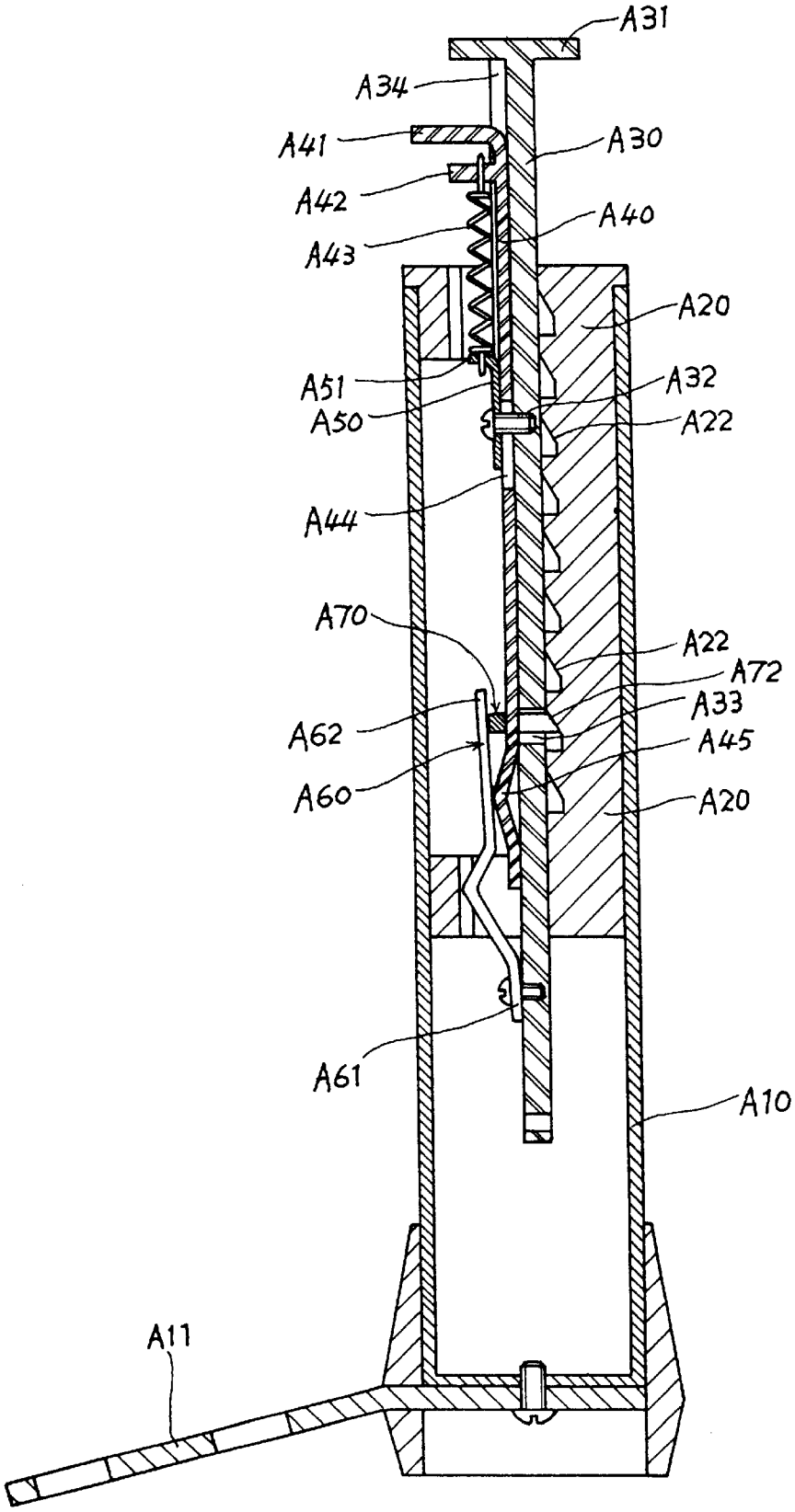
FIG. 6 a sectioned side view of the height-adjusting mechanism for armrest of FIG. 5.

FIGS. 5 and 6 are assembled perspective and sectioned side views, respectively, of a height-adjusting mechanism for armrest according to a second embodiment of the present invention. The second embodiment and the first embodiment are identical in their functions and operations.

The height-adjusting mechanism for armrest according to the second embodiment of the present invention mainly includes a sleeve A10, a lower end of which is screwed to a bracket A11 that is then screwed to a seat of an armchair (not shown) to form an arm support. A tubular member A20 is mounted in the sleeve A10 with an upper end seated on a top of the sleeve A10.

The tubular member A20 is provided with an internal slide way A21, an inner side of which is provided with a vertical row of equally spaced locating holes A22. A wall of the tubular member A20 opposite to the slide way A21 is cut away to form a vertically extended an access window A23, via which related components or parts are conveniently mounted in the tubular member A20.

A slider A30 is vertically movably received in the slide way A21. The slider A30 includes an arm bracket A31 additionally connected to or integrally formed at a top thereof for an armrest (not shown) to connect to the arm bracket A31, and a vertical trough A34 formed at an outer side of the slider A30. A fixing hole A32 and a transverse through hole A33 are separately provided at predetermined positions in the trough A34. An exterior cover (not shown) may be connected to the slider A30 to create an integral appearance of the height-adjusting mechanism.

A long plate A40 is located at the outer side of the slider A30 and has an outward bent upper end to provide handle A41 that is accessible from outside of the outer cover, a horizontal lug A42 provided below the handle A41 for a spring A43 to connect at an upper end thereto, and a vertical long slot A44 formed below the lug A42. A lower end of the long plate A40 is extended through a retaining block A70 and then formed into an outward protruded portion A45.

A fixing plate A50 is located at an outer side of the long plate A40 and is screwed to the slider A30 with a screw extended through the long slot A44 of the long plate A40 and into the fixing hole A32 of the slider A30, such that the long plate A40 is vertically movable in the trough A34 within a range defined by upper and lower ends of the long slot A44. The fixing plate A50 has an outward bent lug A51 at its top to connect to a lower end of the spring A43, such that the long plate A40 automatically returns to a lower position under an elastic force of the spring A43 when the long plate A40 is upward pulled and released again.

A guiding plate A60 having predetermined length and elasticity is screwed at a lower end A61 to a lower end of the slider A30, such that an upper end A62 of the guiding plate A60 elastically presses against the retaining block A70 inward.

The retaining block A70 is a U-shaped block defining an internal space A71 through which the lower end of the long plate A40 extends. Two inner ends A72 of the U-shaped retaining block A70 extend through the transverse slot A33 on the slider A30 and extend into one of the locating holes A22 on the slide way A21. Each inner end A72 of the retaining block A70 has a configuration corresponding to that of the locating hole A22 and preferably includes a right-angled lower end surface and a beveled upper end surface. This configuration allows the retaining block A70 to move only upward to pass over a locating hole A22 but not downward to disengage from the locating hole A22. That is, the retaining block A70 works like a ratchet to allow a one-way adjustment of its position. When the handle A41 is upward pulled, the outward protruded portion A45 of the long plate A40 is moved upward into the internal space A71 of the U-shaped retaining block A70 to directly push the retaining block A70 outward and disengage the two inner ends A72 of the retaining block A70 from the locating hole A22, allowing the slider A30 to slide up and down to a desired height. When the handle A41 is released again, the retaining block A70 is elastically pushed by the guiding plate A60 inward to automatically extend the two inner ends A72 into a new locating hole A22 to complete the adjustment of the armrest in height. The armrest connected to the height-adjusting mechanism of the second embodiment could be adjusted to a desired height through operating procedures completely the same as that described in the first embodiment.

What is claimed is:

1. A height-adjusting mechanism for armrest, comprising:

a sleeve, a lower end of which being screwed to a bracket that is then screwed to a seat of an armchair;

a tubular member being mounted in said sleeve with an upper end seated on a top of said sleeve; said tubular member being provided with an internal slide way, in which a slider is received to support an armrest on an arm bracket thereof;

said height-adjusting mechanism for armrest being characterized in that:

said slide way is provided at an inner side with a vertical row of equally spaced locating holes;

said slider includes a vertical trough formed at an outer side of said slider, and a fixing hole and a transverse through hole separately provided at predetermined positions in said trough;

a long plate is located at the outer side of said slider in said trough and has an outward bent upper end to provide a handle, a horizontal lug provided below said handle for a spring to connect at an upper end thereto, a vertical long slot formed below said lug, and an outward protruded portion formed below said long slot;

a fixing plate and an elongate guiding plate are sequentially fastened to an outer side of said long plate, so that said fixing plate and said guiding plate and said long plate are together fixed onto said slider with said long slot of said long plate corresponding to said fixing hole of said slider, and said long plate is vertically movable in said trough within a range defined by upper and lower ends of said long slot; said fixing plate having an outward bent lug at its top to connect to a lower end of said spring, such that said long plate automatically returns to a lower position under an elastic force of said spring when said long plate is upward pulled and released again;

said guiding plate is formed at a predetermined position with an inward protruded portion to face toward said outward protruded portion of said long plate, and is connected at a lower end to an outer end of a retaining block; and said retaining block is adapted to extend an inner end through said transverse slot on said slider and into one of said locating holes on said slide way;

whereby when said long plate is upward pulled at said handle, said outward protruded portion is brought to push against said inward protruded portion of said guiding plate, causing the lower end of said guiding plate to shift outward and leave an original downward vertical position and bringing said retaining block to disengage from said locating hole and allow said slider to freely move up and down in said slide way until said armrest reaches at a desired height; and when said handle is released, said retaining block is automatically pushed by an elasticity of said guiding plate to engage into another said locating hole to complete the height adjustment of said armrest.

2. The height-adjusting mechanism for armrest as claimed in claim 1, wherein said inner end of said retaining block has a configuration corresponding to that of said locating hole and includes a right-angled lower end surface and a beveled upper end surface, such that said retaining block is allowed to move upward to pass over said locating holes but not downward to disengage from said locating holes.

3. A height-adjusting mechanism for armrest, comprising:

a sleeve, a lower end of which being screwed to a bracket that is then screwed to a seat of an armchair;

a tubular member mounted in said sleeve with an upper end seated on a top of said sleeve, said tubular member being provided with an internal slide way, in which a slider is received to support an armrest on an arm bracket thereof;

said height-adjusting mechanism for armrest being characterized in that:

said slide way is provided at an inner side with a vertical row of equally spaced locating holes;

said slider includes a vertical trough formed at an outer side of said slider, a fixing hole and a transverse through hole separately provided at predetermined positions in said trough;

a long plate is located at the outer side of said slider and has an outward bent upper end to provide a handle, a horizontal lug provided below said handle for a spring to connect at an upper end thereto, and a vertical long slot formed below said lug; a lower end of said long plate being extended through a retaining block and then formed into an outward protruded portion;

a fixing plate is located at an outer side of said long plate and is screwed to said slider with a screw extended through said long slot of said long plate and into said fixing hole of said slider, such that said long plate is vertically movable in said trough of said slider within a range defined by upper and lower ends of said long slot; said fixing plate having an outward bent lug at its top to connect to a lower end of said spring, such that said long plate automatically returns to a lower position under an elastic force of said spring when said long plate is upward pulled and released again;

a guiding plate having predetermined length and elasticity is screwed at a lower end to a lower end of said slider, such that an upper end of said guiding plate elastically presses against said retaining block inward; and said retaining block is a U-shaped block defining an internal space through which the lower end of said long plate extends, two inner ends of said U-shaped retaining block extending through said transverse slot on said slider and extending into one of said locating holes on said slide way;

whereby when said handle is upward pulled, said outward protruded portion of said long plate is moved upward into said internal space of said U-shaped retaining block to directly push said retaining block outward and disengage said two inner ends of said retaining block from said locating hole, allowing said slider to slide up and down to a desired height, and when said handle is released again, said retaining block is elastically pushed by said guiding plate inward to automatically extend said two inner ends into another said locating hole to complete the adjustment of said armrest in height.

4. The height-adjusting mechanism for armrest as claimed in claim 3, wherein each said inner end of said retaining block has a configuration corresponding to that of said locating hole and includes a right-angled lower end surface and a beveled upper end surface, such that said retaining block is allowed to move upward to pass over said locating holes but not downward to disengage from said locating holes.

* * * * *